US005617665A

United States Patent [19]

Hoenig

[11] Patent Number: 5,617,665

[45] Date of Patent: Apr. 8, 1997

[54] ROTATING BREECH GUN

[76] Inventor: George Hoenig, 6521 Morton Dr., Boise, Id. 83704

[21] Appl. No.: 510,257

[22] Filed: Aug. 2, 1995

[51] Int. Cl.[6] ..... F41A 3/00

[52] U.S. Cl. ..... 42/8; 42/10; 42/40; 42/44; 42/41; 42/43

[58] Field of Search ..... 42/39.5, 40, 44, 42/8, 10, 41, 43

[56] References Cited

U.S. PATENT DOCUMENTS 3,568,350 3/1971 Silsby ..... 42/75
4,574,510 3/1986 Nishikawa ..... 42/40
4,897,949 2/1990 Whiteing ..... 42/10
4,934,244 6/1990 Johnson, Jr. ..... 89/12

*Primary Examiner*—J. Woodrow Eldred

[57] ABSTRACT

A break open sporting firearm with one to four barrels that lock up in line directly behind the chambers for strength and rigidity.

The load from firing is taken up by two or more circularly spaced lugs in the breech engaging with mating lugs on the frame.

A rotating breech plate slider and hinge within the breech are the functioning means for this invention.

6 Claims, 2 Drawing Sheets

2
3
4
6
8
8a
8b
10
11
12
14
16
18
20
22
23
24
26
28

ROTATING BREECH GUN

BACKGROUND OF THE INVENTION

Multi barrel firearms are generally of a break open style. The load from firing is taken by a hinge pin and a free standing breech face. This is reasonably satisfactory in the case of shotguns since they are low pressure. Even there many attempts have been made to tie the barrels to the breech face to overcome the momentary separation of the two upon firing. Two of the most common are the dollshead and greener crossbolt. None are as substantial as needed for double rifles and rifle shotgun combinations. The resulting problems are sticking cases in the chamber from stretching and premature looseness in the action. Rifle cartridges with rims designed for break open guns for this reason are loaded to lower pressure and performance than their counterparts for rifles that lock up at the breech.

SUMMARY OF THE INVENTION

The lock up needs to be directly in line with the chambers rigidly connecting the breech with the barrels, eliminating the spring that normally occurs in a hinged type action. This is the object of the invention.

Strong lock up:

The load from firing is taken by circularly spaced locking lugs similar to an artillery breech. Beyond that the gun is designed to still handle a lot like a break open gun with all its other qualities.

Rotary breech face plate:

The apparatus in this invention that makes this design possible is the rotary breech face plate with its slider and hinge. These are all accommodated within the breech. The rotary breech face plate has the following functions.

A. through its cocking cams it cocks the strikers.

B. by the attachment of the hinge and slider to it the gun can be slid and hinged open without it separating into two halves.

C. since the rotary breech face plate does not rotate in relation to the breech, the firing pins remain stationary with the primers. This totally eliminates the problem of firing pin drag so common on many break open guns.

D. the rotary breech face plate also provides a convenient barrier between the breech and the frame and a place for the firing pins.

Simplicity of lock up:

The breech and frame sections of the gun are locked together by a simple quarter turn of one against the other. This eliminates the need for all the complex mechanism found on all break open guns to lock the hinged pieces together via top lever, spring, top lever shaft and bolt, and greener crossbolt, etc.

Inertia extractor:

It utilizes the weight of the barrels in an initial amount of free travel to build up inertia before actuating the extractor. This is an excellent way to break loose cases that may be stuck. This operation can be repeated in the event of very stubborn cases until they break loose. Like a slide hammer it is extremely effective without over loading the extractor by brute camming force resulting in its damage.

Rotary safety:

It uses rotary motion as camming force to move both the sears into full engagement with the strikers. This retracts and hold the strikers from moving forward.

The above describes the gun in a two barrel over and under arrangement. In a three and four barrel version the gun still fires as an over and under. The barrels to be fired are rotated into the over and under position where their firing pins line up with the same two strikers. The cocking cams for this version are modified to cock the strikers in one eighth turn.

DETAILED DESCRIPTION

Figure 1:
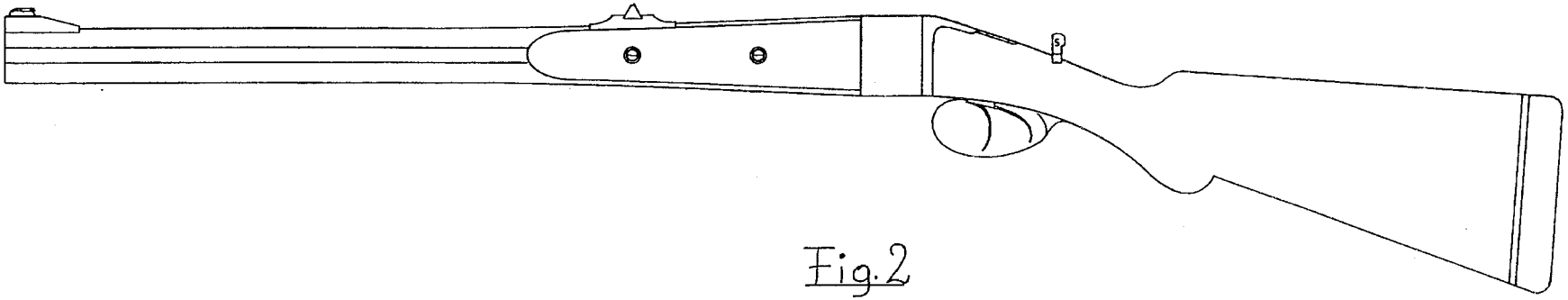
FIG. 1 shows an elevated side of the over and under rifle.
Figure 2:
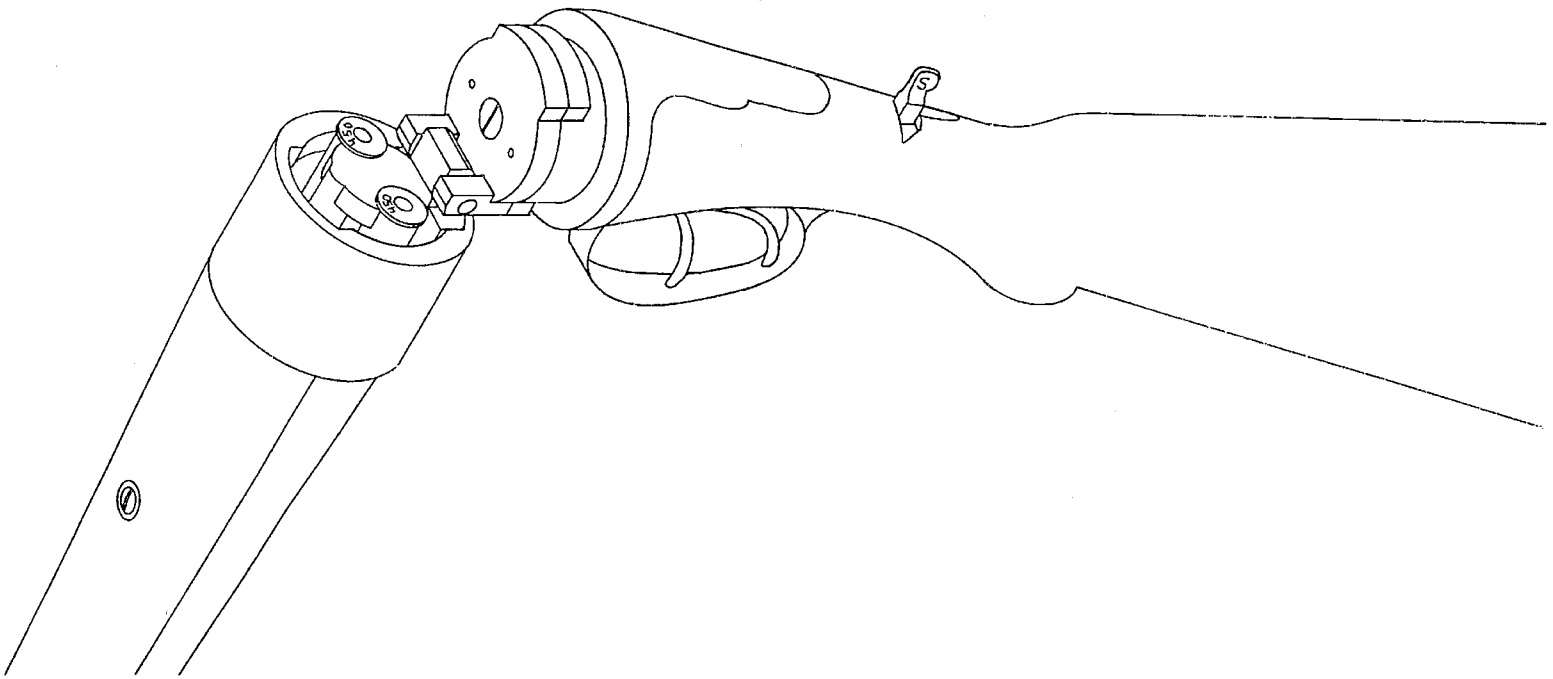
FIG. 2 is an isometric view of the rifle in the open position.
Figures 3, 4, 5:
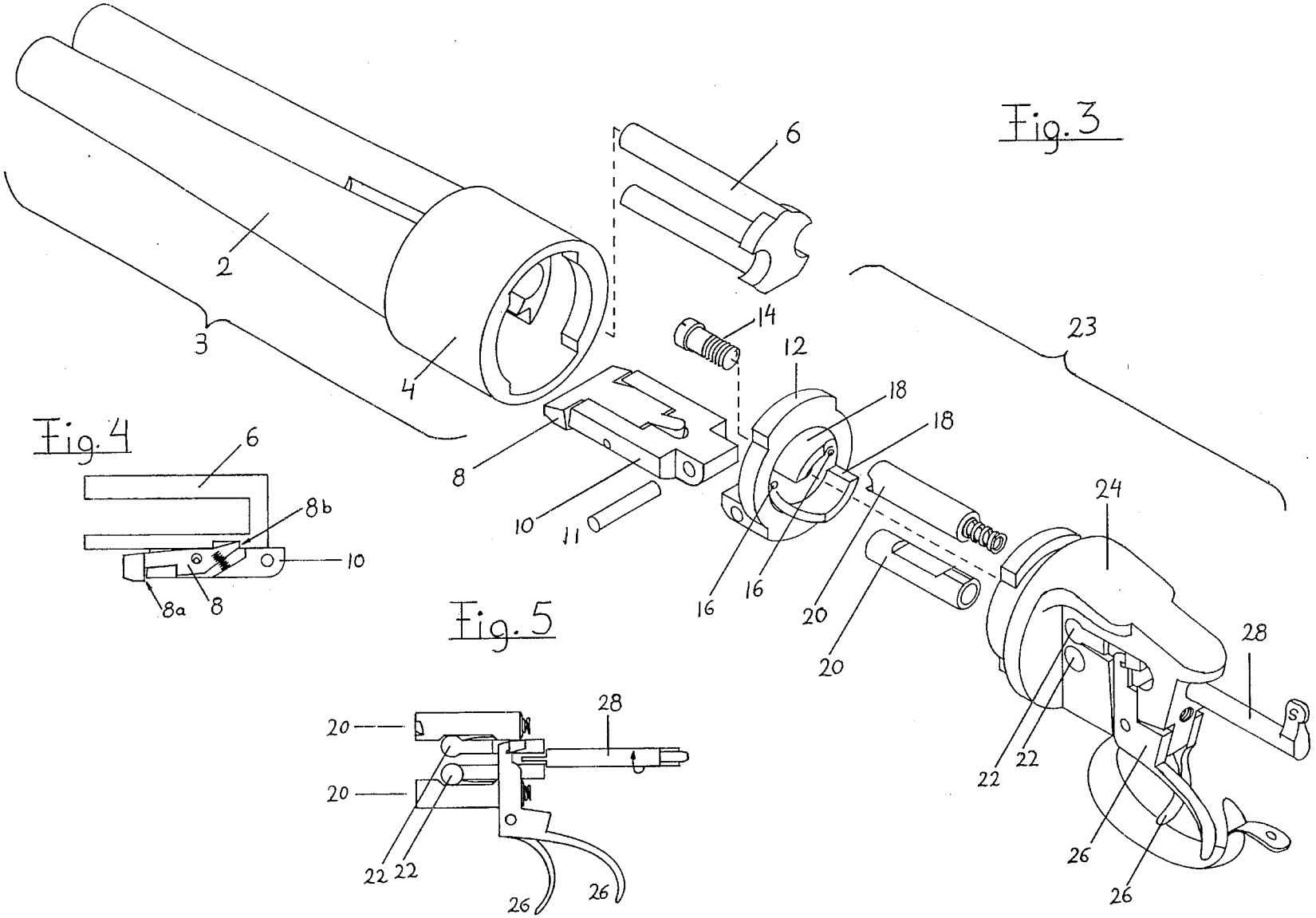
FIG. 3 shows an isometric exploded view as the parts relate to each other.
FIG. 4 is a cross sectional view of the extractor slider latch and slider. Shown is the point where the slider latch and extractor engage.
FIG. 5 is an elevated view showing the strikers sears and triggers and the point where the safety engages the sears.

Referring now to the drawings, there is shown a breech 4 into which are threaded the barrels 2, an extractor 6 which slides in holes provided within the breech, and a slider 10 which rides under the extractor 6 and fits into a straight through opening in the breech.

Shown is a breech face plate 12 which hinges on slider 10 by means of pin 11 and is rotatably mounted to the frame 24 by the use of the face plate screw 14. Said breech face plate 12 contains firing pins 16. The lower shaft of the extractor 6 contains a notch which engages the extractor lip **8*b* of the slider latch 8**.

After an initial amount of free travel of the breech section 3 to build up inertia, the extractor 6 is drawn out as the slider 10 moves to the end of its travel where the takedown lip **8*a* of the slider latch 8 engages the front edge of the breech. At this point the gun can be hinged to provide access to the chambers. This whole process is performed easily in one smooth motion by turning the breech section 3**, sliding it forward and hinging it.

The rotary motion which unlocks the gun is utilized for cocking two spring loading strikers 20 via two cams 18 on the breech face plate 12 which rotates with the breech section 3. The two strikers are held in a cocked position by two sears 22 which in turn are controlled by two triggers 26. The heavily constructed sears 22 are cammed into solid engagement with the strikers 20 by the rotary safety 28. The slider latch 8 performs two functions:

1. the extractor lip **8*b* actuates the extractor 6**
2. the takedown lip **8*a* catches on the front edge breech 4 to act as the slider stop By pulling the extractor 6 further to the rear manually the extractor lip 8*b* will be depressed, raising the takedown lip 8*a*. This allows the breech section 3 and the frame section 23** to slide apart.

What is claimed is:

1. An improved firearm comprising:

a round breech with circularly spaced locking means, said breech having attached to it one of the group of one, two, three, or four barrels a firearm frame having mating locking means engagable with said breech a plate being rotatably mounted on said firearm frame containing a number of firing pins equal to the number of barrels a bar hingeably attached to the front of said plate on which the breech section of the firearm can slide and then hinge.

2. The invention according to claim one wherein said bar is provided with a movable lever as a means for actuating an extractor and also acting as a stop to prevent unintentional separation of the breech and frame sections.

3. The invention according to claim one wherein a set of circular cams are part of the rear of said plate to compress by rotary motion a set of spring loaded strikers.

4. The invention according to claim one wherein said firearm frame contains a set of sears and triggers as a means for holding said spring loaded strikers in a cocked position.

5. The invention according to claim one wherein said firearm frame contains a safety consisting of a rotatable shaft with a wing and two camming surfaces on the opposite end engageable with said sears to force them into full engagement with the said strikers to solidly block them.

6. The invention according to claim one wherein said breech an extractor is slideably mounted to be acted upon by the inertia of the two firearm sections as they are being slid apart.

* * * * *